United States Patent [19]

Friz

[11] 4,115,721

[45] Sep. 19, 1978

[54] TRAVELING WAVE DEVICE WITH UNIFIC COMPOSITE METAL DIELECTRIC HELIX AND METHOD FOR FORMING

[75] Inventor: Walter Friz, Yellow Springs, Ohio

[73] Assignee: Louis E. Hay, Dayton, Ohio

[21] Appl. No.: 757,698

[22] Filed: Jan. 7, 1977

[51] Int. Cl.[2] ..... H01J 25/34

[52] U.S. Cl. ..... 315/3.5; 29/25.14; 29/600; 29/25.17; 315/39.3; 333/31 R

[58] Field of Search ..... 315/3.5, 3.6, 39.3; 333/31 R; 29/25.14, 25.17, 600

[56] References Cited

U.S. PATENT DOCUMENTS

| | | | |
|---|---|---|---|
| 3,505,730 | 4/1970 | Nelson | 29/600 |
| 3,610,999 | 10/1971 | Falce | 315/3.5 |
| 3,670,196 | 6/1972 | Smith | 315/3.5 |
| 3,691,630 | 9/1972 | Burgess et al. | 315/3.5 |
| 3,705,327 | 12/1972 | Scott | 315/3.5 |

*Primary Examiner*—Saxfield Chatmon, Jr.

[57] ABSTRACT

A traveling wave device having a metallic helical core element which is ceramic coated on its peripheral surfaces to provide a heat transferring dielectric and which is in intimate peripheral contact within the body of said device, to thus provide a simplified and long-life structure having improved heat conductivity permitting greater RF output and size-weight reduction of said device; and methods for forming and coating the helices.

20 Claims, 4 Drawing Figures

RF OUT
RF IN
10
12
14
16
20
22
24
26
28
30
32
34
36
38
40
42
44
44a
44b
46
48

TRAVELING WAVE DEVICE WITH UNIFIC COMPOSITE METAL DIELECTRIC HELIX AND METHOD FOR FORMING

BACKGROUND OF THE INVENTION

The present invention relates generally to the field of traveling wave devices or tubes, and more specifically to the production of such devices having a greatly increased RF output, reduction in weight and substantially reduced production costs through design simplification and new production techniques.

During the past two decades traveling wave tubes have become the most prominent electron device for the generation and amplification of RF power in the microwave and millimeter bands of the transmission spectrum. Two typical uses of traveling wave tubes are in the communication and the guidance fields. There are other well known fields for these devices.

The traveling wave tube derives its name from the manner in which DC energy is converted to RF energy. This conversion is accomplished by a traveling but delayed electromagnetic wave interacting with an electron beam in the same direction and at substantially the same velocity or "travel". It is essential to the successful operation of a traveling wave tube that there be a transfer of DC beam energy to the electromagnetic circuit wave at synchronism of the beam and the wave velocity. This traveling and distributed interaction explains the dominance at the higher frequencies of the traveling wave devices over grid controlled tubes in which the interaction fields are stationary and with shorter wave lengths which limit the interaction energy transfer. The key element in a traveling wave tube, which permits the high energy conversion, is a delay line which functions to reduce the velocity of the electromagnetic wave from its natural speed of light to a speed which substantially matches the velocity of the electron beam passing through and coaxial with the delay line. There are two common types of traveling wave devices. The first is known as the O type in which the gainful energy exchange derives from the kinetic energy of the electron beam. The second is known as the M type in which the interaction energy derives from the potential energy of the electron beam.

Of the slow wave structures devised for use in traveling wave devices, the helical configuration is the more common. Both unifilar and multifilar helices have been used. In the O type device a circular unifilar helix with predetermined pitch is the nearly exclusive form used in low and medium output devices, and the operational bandwidths are the widest obtained to date in delay lines. However, such helices (both unifilar and multifilar) when operation is attempted above a definite voltage limit, in an attempt to increase beam power, have a notorious tendency to support backward wave interaction. Such tendency is sufficient for self maintained backward wave oscillations. This is a desireable characteristic when the traveling wave device is used as an oscillator; however, in amplifier applications this characteristic is very detrimental. Thus for a long time, the cross-wound helix called a ring bar circuit, has been used because this circuit does not support the backward mode while at the same time allows for substantially larger peak power output. There is a penalty when using a ring bar circuit in that there is a much smaller bandwidth performance, in addition to higher manufacturing costs. Their principal use is thus in applications where bandwidth limitations are not of prime consideration.

The major technical problem which must be overcome before the power output of traveling wave devices can be increased by any substantial amount, is to find a way for removing and dissipating heat generated in the helical slow wave structures. Since the slow wave structure is coaxial within the body of the traveling wave tube, it must be supported within the tube by means which are dielectric while at the same time forming the only means for the transfer of heat from the slow wave structure to the outer body shell structure which acts as a heat sink.

One method has been to support the slow wave structure by means of a plurality of ceramic rods as illustrated in FIG. 3. It is obvious that this configuration provides the poorest possible heat transfer areas and that heat will be extracted from a relatively small area of the slow wave structure.

The best known published art relating to the present invention is covered by U.S. Pat. No. 3,670,196 Helix Delay Line For Traveling Wave Devices, Burton H. Smith. This structure presents very severe manufacturing problems and would also be costly out of all proportion. There is no knowledge of production traveling wave devices having been built in accordance with this patent.

Traveling wave devices are being built at the present time in which a plurality of diamonds support the slow wave structure within the body of the devices. The diamonds have been found to be a good heat transfer media; however, it is obvious that those areas of the slow wave structure not in direct contact with the diamonds will become "hot spots".

SUMMARY OF THE INVENTION

In accordance with the teachings of the present invention, the helix comprising the slow wave structure is bonded by particulate deposition on its peripheral surfaces with a high temperature dielectric such as ceramic to form an unific structure. After bonding, the strudture is ground to specific diameter in order to provide intimate contact with the body of the traveling wave device when in final assembled position. For purposes of this invention, the term "helix" is to encompass all forms of dielectric supported slow wave structures which generate a traveling electromagnetic wave, and not be limited to a helix such as a screw thread.

The dielectric material is preferably applied to the metallic portion of the slow wave structure while it is mounted on a disposable mandrel. Such a mandrel will provide support during the grinding operation to maintain structural integrity, and will also prevent deposition of the dielectric to non-intended surfaces. The dielectric is preferably applied by plasma spraying; however, other methods of particulate deposition may be used.

A slow wave structure formed in accordance with the present invention does not have the detrimental dielectric bridging of adjacent helix circuit elements. Furthermore, since the entire peripheral area is covered with a thermally conductive dielectric which dissipates heat into the body of the traveling wave tube, there are no "hot spots" to limit beam output. As will be shown in the preferred embodiment, the dielectric is prevented from extending beyond the metallic structure.

After the slow wave structure has been ground to size, it may be installed into final position within the body of the traveling wave device. With a one piece body, the body may be heated and allowed to shrink cool into intimate contact with the slow wave structure, after which the mandrel is removed by chemical etching. Giving due consideration to the size and strength of the slow wave structure, in some situations the mandrel may be removed before the slow wave structure is installed into the traveling wave device. Other methods of body construction, as used in the past may also be used.

A slow wave structure in accordance with the present invention has the maximum heat transfer capability, no adverse dielectric bridging, and is accordingly capable of greatly increased output capability.

DESCRIPTION OF THE PREFERRED EMBODIMENT

Figures 1, 2, 3:
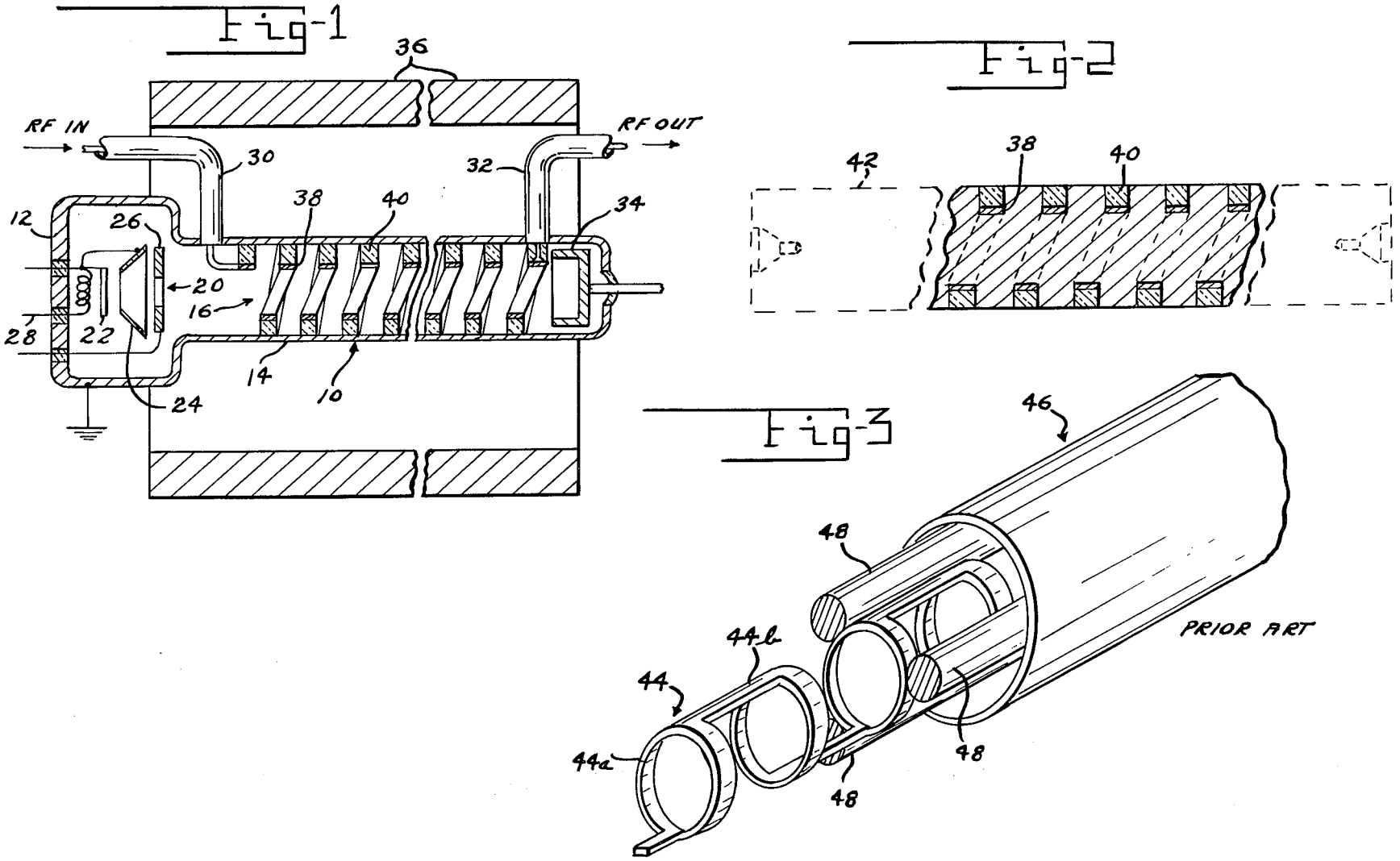
Fig-3 PRIOR ART
FIG. 1 is a cross-sectional view of a typical traveling wave device utilizing a slow wave structure in accordance with the present invention.
FIG. 2 is a cross-sectional view of a unifilar slow wave structure supported on a mandrel and made in accordance with the present invention.
FIG. 3 is a partial perspective of a prior art traveling wave device having a metallic ring bar slow wave element supported within the traveling wave device by three ceramic rods; and, FIG. 4 is a perspective showing assembly of a metallic ring bar slow wave element onto a mandrel in preparation for the particulate deposition of a dielectric in accordance with the present invention.

Referring to FIG. 1 which incorporates the embodiment of the invention, the traveling wave device 10 has an elongated metallic body member 12 having a longitudinal tubular body element 14. Supported within the longitudinal tubular element in fixed relationship is an helical slow wave structure 16 which will be described in greater detail below.

Housed and supported within one end of the body member 12 is a conventional electron gun 20 having a cathode 22, a focusing electrode 24 and an accelerating anode 26. Suitable DC is applied through leads 28. The electron gun is positioned to project its electron beam output coaxial with the longitudinal axis of slow wave structure 16. As depicted, the electron gun is longitudinally displaced from the first end of slow wave structure 16. As further depicted, the portion of body member 12 which houses the electron gun 20 is of larger diameter than the portion of the body member housing the slow wave structure. This is not a requirement except in situations where the envelope of the electron gun is of diameter larger than that of the slow wave structure.

RF energy is coupled to the metallic portion of the slow wave structure as depicted by means of input line 30 and output line 32. Such lines are well known to the art and need not be further described.

A collector 34 is housed and dielectrically supported within body member 14. The collector is longitudinally displaced from the second end of slow wave structure 16 and is preferably coaxial with the slow wave structure and the electron gun 20. The collector collects and dissipates the electrons spent from the second end of the slow wave structure in a manner well known to the art.

The body member 12 is encompassed by an electromagnetic means 36 which is coaxial with the electron beam being propagated on the axis of the slow wave structure 16. The purpose of the electromagnetic means is to prevent beam spread and deviation.

The slow wave structure comprises a metallic ribbon 38 and a dielectric 40. In FIG. 1 the ribbon is shown as an unifilar helix for illustrative purposes. Within the scope of the present invention, the "helix" may take geometric forms other than unifilar, as for example, multifilar or a cross-wound helix called a ring bar circuit. These so called "helices" all have the function of interacting in a specific manner with the electron beam propagating therethrough. In other words, regardless of their exact configuration, they perform the same electrical function.

The peripheral surface of the ribbon 38 is bonded by particulate deposition with a dielectric 40 by a method which is novel to the art. As will be further described below, this method has produced slow wave structures which are relatively easy to manufacture and install, and which, because of superior heat transfer capability, permit a higher energy output by traveling wave devices.

Reference is now made to FIG. 2 which is a partial cross-section of a mandrel 42 on which the slow wave structure 16 is formed in the novel manner. The mandrel is formed of a material which will be chemically reactive with the etching fluid to be used. The mandrel is preferably turned to a diameter slightly larger than the diameter of the finished slow wave structure. A helical thread is cut onto the mandrel to a predetermined pitch commensurate with the frequency requirements of the traveling wave device. The root diameter of the helical thread is substantially the inside diameter of the slow wave structure. The width of the helical thread is preferably the minimum width which will receive the metallic inner ribbon 38. The helical thread is preferably a square cut thread; that is, the sides of the thread are parallel. This form of thread eliminates any possibility of longitudinal overlap between the ribbon 38 and the dielectric 40 which is to be externally applied. As indicated in FIG. 2, the mandrel may have lathe centers for supporting the mandrel in fixtures. The mandrel may also be held by collets or other holding devices, all of which are well known to the art.

After the mandrel is formed, a metallic ribbon 38, in strip form, is wound against the root diameter of the helical thread. The dielectric is now applied to the exposed surface of the metallic ribbon by particulate deposition such as by the plasma spray method. Enough of the dielectric material is applied to at least completely fill the helical thread in the mandrel. It is preferable to apply a surplus amount of dielectric to assure that there are no cavities.

The mandrel and dielectric are now precision ground to the predetermined diameter, as by centerless grinding, after which the mandrel is removed by the chemical etching process. This method will produce a superior slow wave structure for several reasons. In the first place, there is perfect pitch and dimentional control because the mandrel gives full support to all dimensions during all stages of manufacture. Furthermore, since both the diameter of the slow wave structure and the bore within tubular element 14 of body member 12 can be ground to very close dimensional tolerances, the maximum possible heat transfer will be provided. Additionally, the dielectric is in exact longitudinal alignment on the ribbon over the full length of the slow wave structure. The dielectric is preferably a ceramic such as beryllium oxide. Magnesium oxide and aluminum oxide are also suitable materials. If desired, a small amount of powdered glass may be added to the oxide to be applied for cohesion improvement.

Since the ribbon 38 is metallic, as well as the mandrel 42 which is to be removed by chemical etching, there must be a proper selection of metals and etching fluid. The ribbon must be of a material impervious to the etching fluid. For example, tungsten may be used for the ribbon, the mandrel may be made of molybdenum, and the etching fluid may be a solution of 50–75% formic acid and 25–50% hydrogen peroxide. There are other combinations of materials which may be used. A good reference is "Corrosive Data Survey" 1960 Edition, by G. A. Helson, Shell Development Company.

If desired, a thin coating of a ductile material such as gold may be applied to the outer diameter of ribbon 38 before deposition of dielectric 40. In like manner a coating may be applied to the outer surface of the dielectric. One purpose of such coatings would be to fill any minute voids in the dielectric and thereby assure optimum surface in heat transferring contact. The admixture of a small percentage of a chemical reactive material into the plating materials can increase the adhesive strength in the metal-ceramic bonds. Care in the selection must be exercised to prevent an adverse effect on thermal conductivity. When a coating is to be applied to the outer surface of the dielectric, the mandrel and dielectric may first be ground several thousanths of an inch undersize, the coating applied, and the mandrel and dielectric refinished to the predetermined size. For purposes of this invention, the dielectric may be regarded as being either with or without coatings since such coatings do not contribute a new function and are well known to the art. If desired, the outer coating may be applied to the inner area of the tubular element 14 of the body member 12.

FIG. 3 is illustrative of the conventional method of supporting a helix in the form of a ring bar circuit within a traveling wave device. A slow wave structure 44 is supported within a traveling wave device 46 by means of three ceramic rods 48. The slow wave structure 44 comprises a plurality of rings 44*a* which are connected with bars 44*b*. Adjacent bars are oriented 180 degrees with each other. In addition to the dielectric bridging, which is detrimental, the structure has poor heat transferring capability because of the small contact areas which theoretically are line contacts. Even when the rods 48 are made arcuate, to provide more surface contact, the contact areas remain small and "hot spots" develop. As will be shown, slow wave structures of ring bar form are within the scope of the present invention; however, the required mandrel is more complicated.

Figure 4:
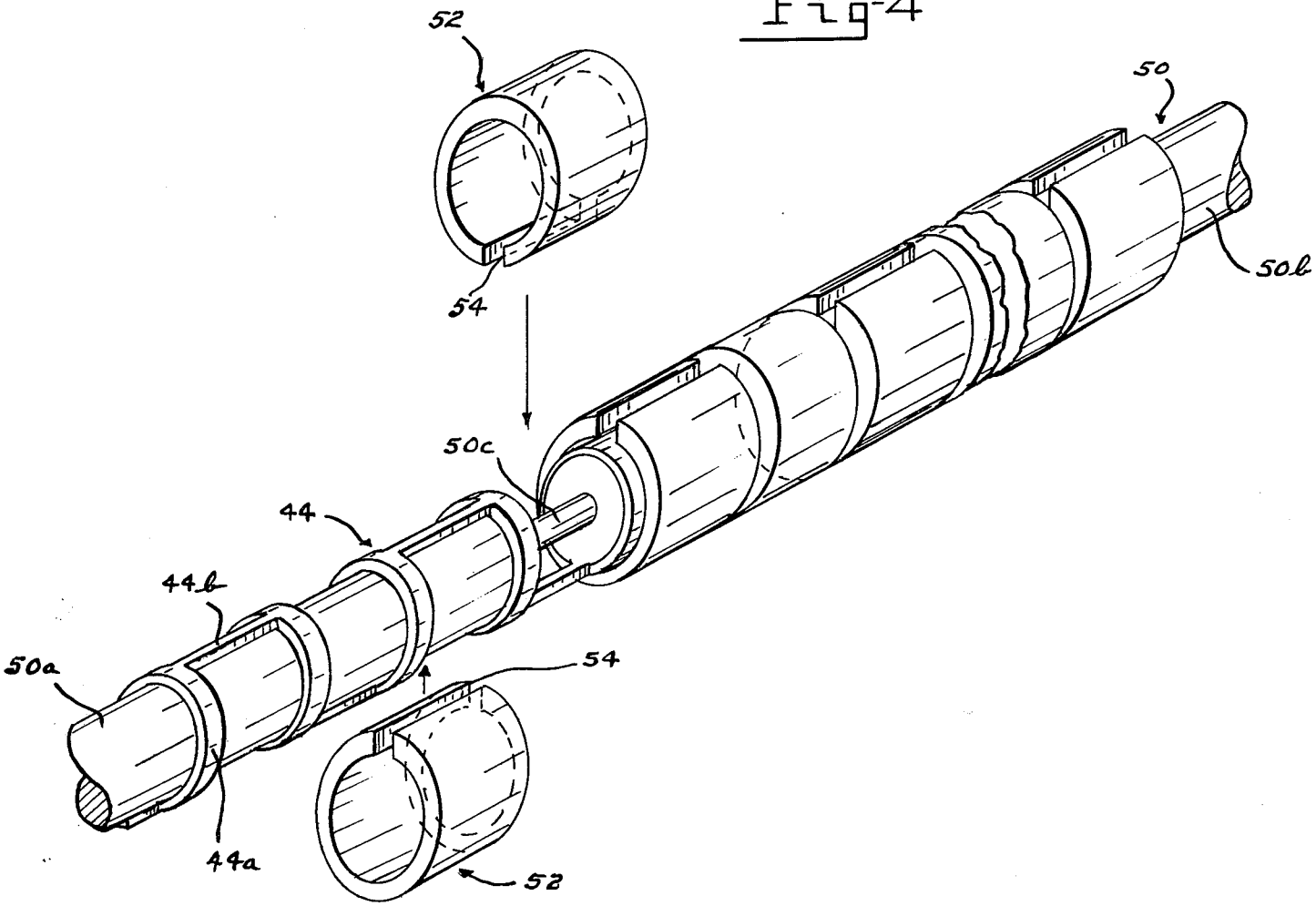

FIG. 4 is illustrative of a mandrel which can be used. The mandrel 50 is a spool mandrel having two major end portions 50*a* and 50*b*, and a central portion 50*c*. The end portions 50*a* and 50*b* are of sliding fit diameter with the inside diameter of the slow wave structure 44. The central portion 50*c* has a diameter very slightly smaller than the width of the bars 44*b* on the slow wave structure and a length substantially equal to the length of bars 44*b*. A plurality of slotted rings 52 are also required. Each slotted ring is of a length substantially equal to the length of bars 44*b* and is of such internal diameter to slip over the outside diameter of the mandrel. The width of the slot 54 is very slightly greater than the width of the bars 44*b*. The outside diameter of each slotted ring is slightly greater that the finished diameter of the slow wave structure after the dielectric has been applied by the particulate deposition method previously described.

On assembly, the slow wave structure 44 is slipped onto the mandrel portion 50*a* and is advanced to the right until the first bar 44*b* is in longitudinal alignment with the mandrel portion 50*c*, after which the slotted ring 52 is inserted as illustrated. The slow wave structure is then advanced to the right until the next bar is in alignment, and the next slotted ring is inserted. The assembly so formed is now ready for application of the dielectric after which it is ground to size and the mandrel removed by chemical etching.

For economy, the mandrel 50 may be made in two pieces. For example, the end portion 50*a* may be made with the central portion 50*c* integral. The end of 50*c* may be threaded to engage a female thread in the end portion 50*b*. After the slow wave structure 44 is completely assembled onto 50*b*, the end portion 50*a* can be unscrewed and saved for the next assembly rather than being destroyed during the etching process.

If desired, after either slow wave structure has been ground to predetermined diameter, it may be installed into the body member of the traveling wave device before removing the mandrel by etching. The etching fluid previously mentioned will not attack a copper body or coatings such as gold. This assembly procedure will assure configuration integrity. It will also assure that small and delicate slow wave structures will not be broken in handling or during assembly into the traveling wave devices.

I claim:

1. A traveling wave device comprising:

(a) a body member having a longitudinal tubular element;

(b) an elongated unific slow wave structure in intimate contact within the tubular element of said body member, said slow wave structure comprising a metallic core with predetermined electrical characteristics over a predetermined frequency range, and a dielectric deposition deposited to the peripheral surface of said metallic core to form said unific slow wave structure;

(c) means within said body member spaced from the first end of and coaxial with said slow wave structure for generating and projecting an electron beam through said slow wave structure;

(d) RF energy means joined to said slow wave structure, the electron beam interacting with and amplifying the RF energy flowing through said traveling wave device;

(e) magnetic means surrounding said body member for producing a magnetic field guiding the electron beam; and (f) collector means within said body member spaced from the second end of said slow wave structure for collecting the spent electron beam.

2. A traveling wave device in accordance with claim 1 wherein said slow wave structure is radially supported in interference fit within the tubular element of said body member.

3. A traveling wave device in accordance with claim 1 wherein said slow wave structure is ground to predetermined contour and shrink-fitted in position within the tubular element of said body member.

4. A traveling wave device in accordance with claim 1 wherein said slow wave structure is metallic coated on the peripheral surface thereof with a particulate deposited dielectric for bonding to the tubular element of said body member.

5. An elongated unific slow wave structure for a traveling wave device or the like, comprising;

(a) an elongated helical metallic core having predetermined electrical characteristics over a predetermined frequency range; and (b) a dielectric deposition deposited to the peripheral surface of said metallic core to form said unific slow wave structure.

6. A slow wave structure in accordance with claim 5 wherein said dielectric is a ceramic.

7. A slow wave structure in accordance with claim 5 wherein the peripheral surface of a particulate deposited dielectric is metallic coated.

8. A slow wave structure in accordance with claim 5 wherein said dielectric is a ceramic the peripheral surface of which is metallic coated.

9. A method of making a unific slow wave structure having an metallic core bonded on the peripheral surface thereof with a dielectric comprising the steps:

(a) forming a disposable mandrel externally configured to support said metallic core with the peripheral surface exposed;

(b) applying a dielectric deposition to the peripheral surface of said metallic core to form said unific slow wave structure and (c) disposing said mandrel by chemical etching.

10. A method of making a unific slow wave structure having an metallic core bonded on the peripheral surface thereof with a dielectric comprising the steps:

(a) forming a disposable mandrel externally configured to support said metallic core with the peripheral surface exposed;

(b) applying a dielectric deposition to the peripheral surface of said metallic core to form said unific slow wave structure;

(c) grinding the dielectric to predetermined contour; and (d) disposing said mandrel by chemical deposition.

11. A method of making a slow wave structure in accordance with claim 10 in which the dielectric is ceramic.

12. A method of making a slow wave structure in accordance with claim 10 in which the dielectric is plasma sprayed ceramic.

13. A method of making a unific slow wave structure having an metallic core bonded on the peripheral surface thereof with a dielectric comprising the steps:

(a) forming a disposable mandrel externally configured to nest and support said metallic core with the peripheral surface exposed, said core being nested to a depth at least as great as the desired thickness of said dielectric;

(b) applying a dielectric deposition to the peripheral surface of said metallic core to form said unific slow wave structure;

(c) grinding the dielectric to predetermined contour; and (d) disposing the mandrel by chemical etching.

14. A method of making a slow wave structure in accordance with claim 13 in which the dielectric is ceramic.

15. A method of making a slow wave structure in accordance with claim 13 in which the dielectric is plasma sprayed ceramic.

16. A method of making and installing into a traveling wave device or the like, a unific slow wave structure having an metallic core bonded on the peripheral surface thereof with a dielectric comprising the steps:

(a) forming a disposable mandrel externally configured to nest and support said metallic core with the peripheral surface exposed, said core being nested to a depth at least as great as the desired thickness of said dielectric;

(b) applying a dielectric deposition to the peripheral surface of said metallic core to form said unific slow wave structure;

(c) grinding the dielectric to predetermined contour while on the mandrel;

(d) insert said slow wave structure with mandrel into said device to place said slow wave structure into final affixed assembly position within said device; and (e) disposing said mandrel by chemical etching.

17. A method of making and installing a slow wave structure in accordance with claim 16 in which the dielectric is ceramic.

18. A method of making and installing a slow wave structure in accordance with claim 16 in which the dielectric is plasma sprayed ceramic.

19. A method of making and installing a slow wave structure in accordance with claim 16 wherein said slow wave structure is metallic coated on the peripheral surface of a particulate deposited dielectric for bonding to said device.

20. A method of making and installing a slow wave structure in accordance with claim 16 in which the dielectric is plasma sprayed ceramic metallic coated on the peripheral surface of said ceramic for bonding to said device.

* * * * *

UNITED STATES PATENT AND TRADEMARK OFFICE

CERTIFICATE OF CORRECTION

PATENT NO. : 4,115,721

DATED : September 19, 1978

INVENTOR(S) : Walter Friz

It is certified that error appears in the above-identified patent and that said Letters Patent are hereby corrected as shown below:

Delete: [73] Assignee: Louis E. Hay, Dayton, Ohio
and substitute the following corrected to read:

[73] Assignee: Louis E. Hay, Dayton, Ohio, a part interest.

In column 2, line 41, change "strudture" to -- structure --.

In column 3, lines 38-39 between "an" and "helical", insert -- unific --.

In claim 16, line 2, change "a" to -- an --.

In claim 16, line 3, change "an" to -- a --.

Signed and Sealed this

*Third* Day of *June 1980*

[SEAL]

*Attest:*

SIDNEY A. DIAMOND

*Attesting Officer*

*Commissioner of Patents and Trademarks*